US005302267A

United States Patent [19]

Mauser et al.

[11] Patent Number: 5,302,267

[45] Date of Patent: Apr. 12, 1994

[54] GOLD PLATING KIT APPARATUS

[76] Inventors: Oscar W. Mauser; Maura E. Mauser, both of 11111 Verdant Rd., Owings Mills, Md. 21117

[21] Appl. No.: 51,980

[22] Filed: Apr. 26, 1993

[51] Int. Cl.[5] ..... C25D 17/00; C25D 17/12

[52] U.S. Cl. ..... 204/224 R; 204/228; 204/284; 204/297 R; 204/271

[58] Field of Search ..... 204/228, 271, 297 R, 204/224 R; 205/120, 266–268

[56] References Cited

U.S. PATENT DOCUMENTS 1,144,680 6/1915 Allers ..... 204/267

3,520,792 7/1970 Kerschgens ..... 204/271 X 3,752,752 8/1973 Slatin et al. ..... 204/271 X 4,668,364 5/1987 Farmer et al. ..... 204/271 X

*Primary Examiner*—Donald R. Valentine

*Attorney, Agent, or Firm*—Leon Gilden

[57] ABSTRACT

A kit structure arranged to include a support container having various components for gold plating a workpiece, to include a fluid container or beaker, with a battery operative through a voltage regulator, wherein the voltage regulator is adjustable to permit selective limited or unregulated voltage control from an associated battery to a gold anode plate and to a workpiece within a solution of sodium cyanide and gold chloride.

2 Claims, 4 Drawing Sheets

GOLD PLATING KIT APPARATUS

BACKGROUND OF THE INVENTION

1. Field of the Invention

The field of invention relates to gold plating structure, and more particularly pertains to a new and improved gold plating kit apparatus arranged to effect the electrolytic plating of a workpiece.

2. Description of the Prior Art

U.S. Pat. Nos. 4,913,787; 4,497,696; 4,310,391; and 3,963,455 are prior art examples of gold plating structure and methods associated therewith.

The instant invention attempts to overcome deficiencies of the prior art by providing for various components in a kit form to permit ease of gold plating of a workpiece and in this respect, the present invention substantially fulfills this need.

SUMMARY OF THE INVENTION

In view of the foregoing disadvantages inherent in the known types of gold plating apparatus now present in the prior art, the present invention provides a gold plating kit apparatus wherein the same provides for various components to permit the gold plating of a workpiece within a solution of sodium cyanide and gold chloride. As such, the general purpose of the present invention, which will be described subsequently in greater detail, is to provide a new and improved gold plating kit apparatus which has all the advantages of the prior art gold plating apparatus and none of the disadvantages.

To attain this, the present invention provides a kit structure arranged to include a support container having various components for gold plating a workpiece, to include a fluid container or beaker, with a battery operative through a voltage regulator, wherein the voltage regulator is adjustable to permit selective limited or unregulated voltage control from an associated battery to a gold anode plate and to a workpiece within a solution of sodium cyanide and gold chloride.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gold plating kit apparatus which has all the advantages of the prior art gold plating apparatus and none of the disadvantages.

It is another object of the present invention to provide a new and improved gold plating kit apparatus which may be easily and efficiently manufactured and marketed.

It is a further object of the present invention to provide a new and improved gold plating kit apparatus which is of a durable and reliable construction.

An even further object of the present invention is to provide a new and improved gold plating kit apparatus which is susceptible of a low cost of manufacture with regard to both materials and labor, and which accordingly is then susceptible of low prices of sale to the consuming public, thereby making such gold plating kit apparatus economically available to the buying public.

Still yet another object of the present invention is to provide a new and improved gold plating kit apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
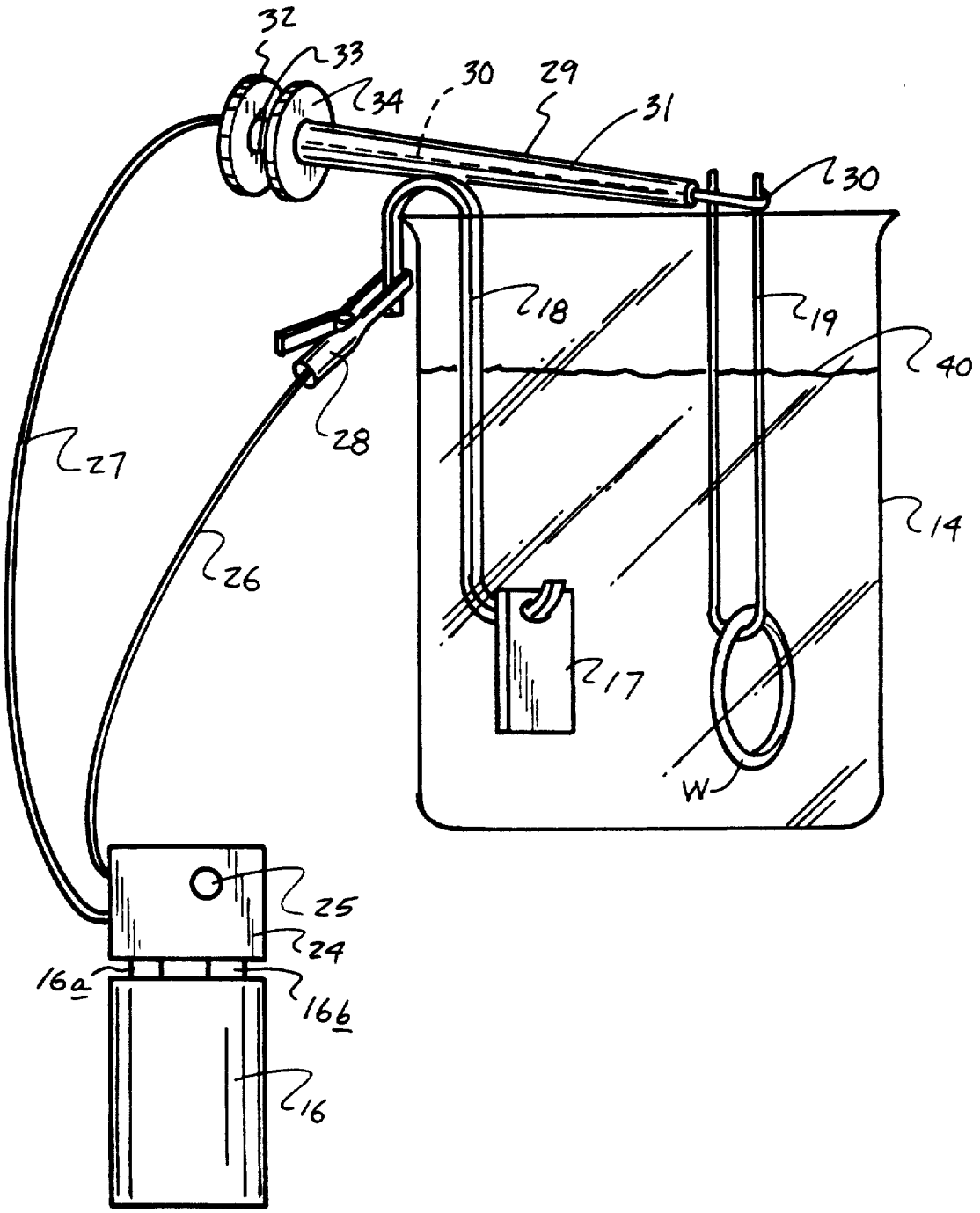
FIG. 1 is an orthographic view of the invention in use.

With reference now to the drawings, and in particular to FIGS. 1 to 5 thereof, a new and improved gold plating kit apparatus embodying the principles and concepts of the present invention and generally designated by the reference numeral 10 will be described.

Figure 3:
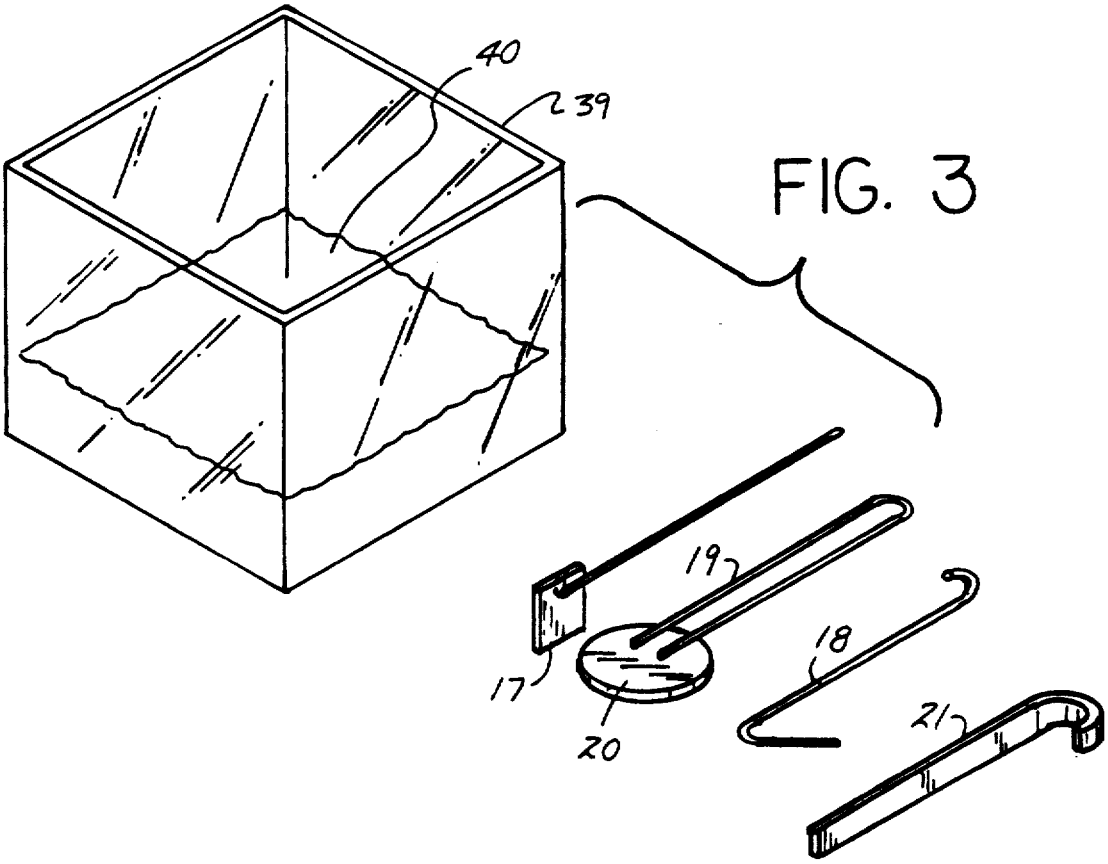
FIG. 3 is an isometric illustration of a fluid container arranged to contain a solution prior to positioning a workpiece therewithin.
Figure 4:
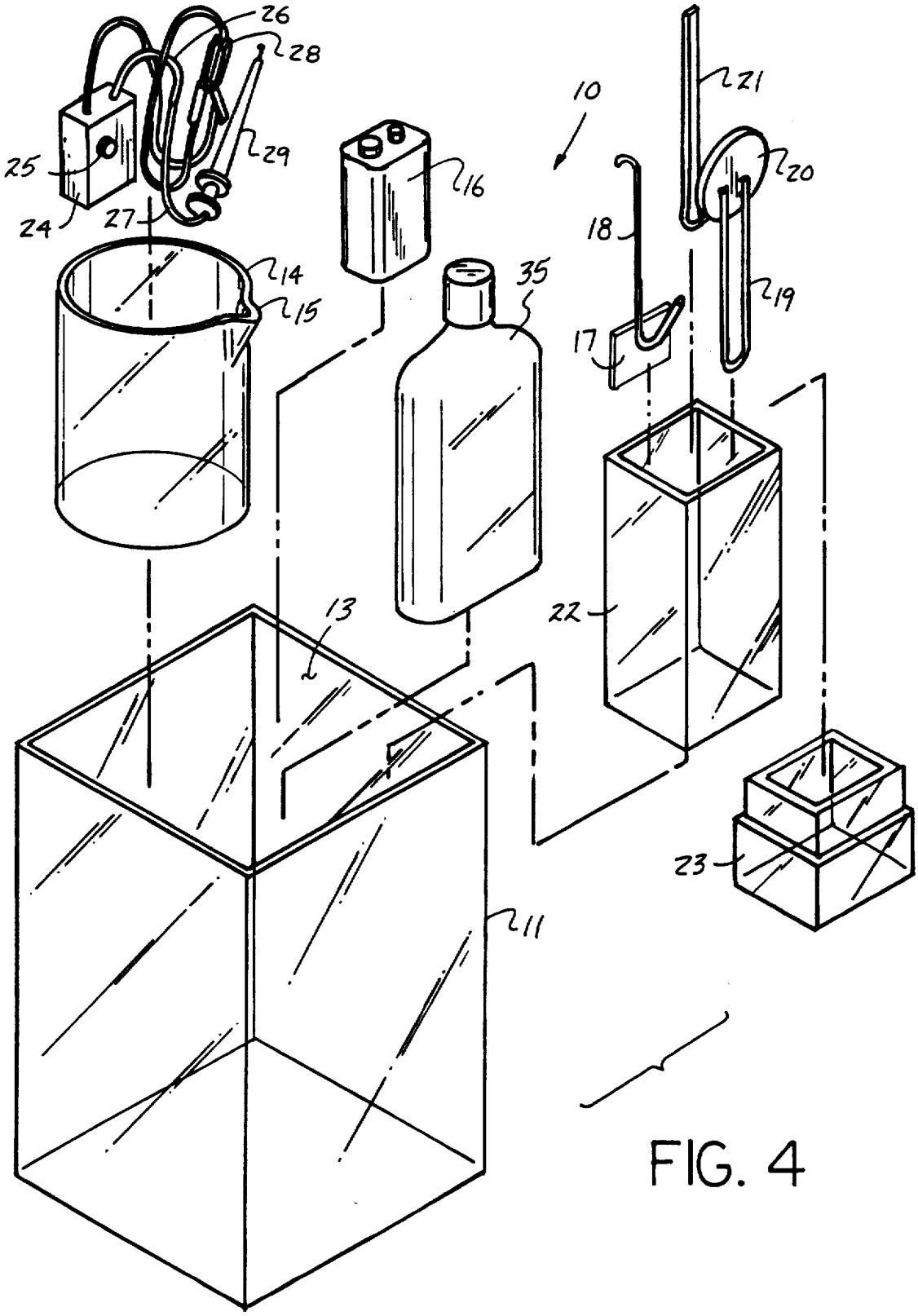
FIG. 4 is an isometric illustration of the kit structure in an exploded view.
Figure 5:
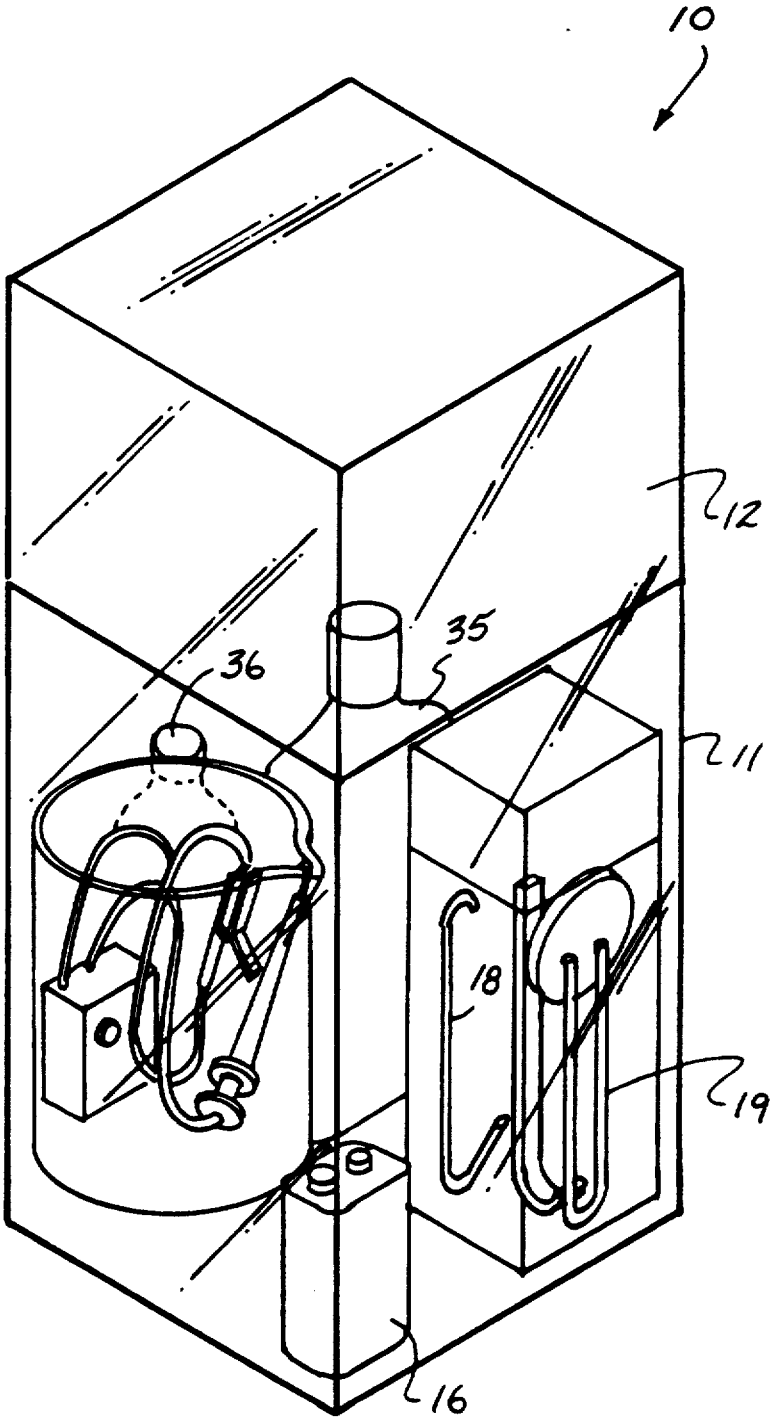
FIG. 5 is an isometric illustration of the kit arranged within the storage container.

More specifically, the gold plating kit apparatus 10 of the instant invention essentially comprises a storage container 11 having a storage container lid 12, with a container cavity 13 directed within the storage container for housing various components such as a beaker 14, including a pour spout 15, a battery 16, a gold anode plate 17 typically constructed of twenty-four carat gold, with a support clip 18 arranged for mounting the gold anode plate 17. A further support clip 19 is provided as well as a mounting clip 21 for support of various workpieces within a fluid container 39 of a type such as indicated in FIG. 3, within the beaker 14. The clip 19 may be provided with an abutment plate 20, as indicated, providing ease of mounting of the further support clip 19 to an associated mounting clip 29. A support housing 22 (see FIG. 4) is provided, having a support housing lid 23 to position the various support clip structure 18, 19, and 21 therewithin, as well as the gold anode plate 17.

Figure 2:
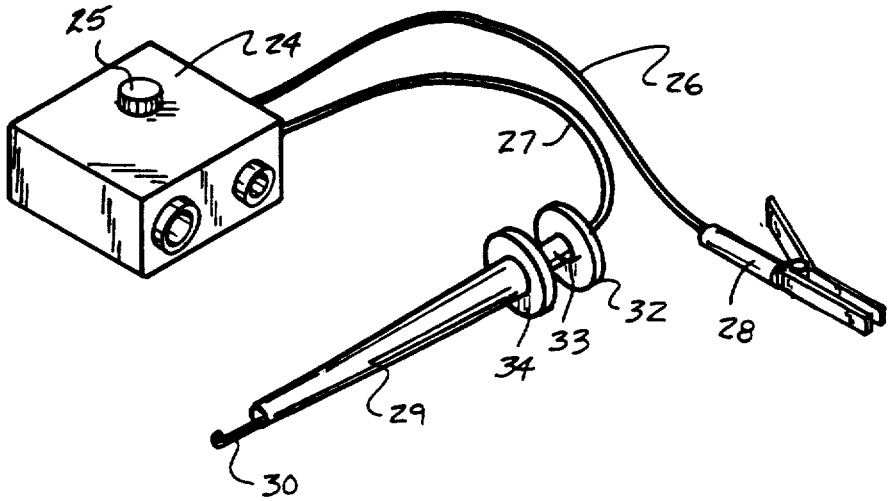
FIG. 2 is an isometric illustration of the voltage regulator structure in association with the clamp arrangement relative to the positive and negative cables.

A voltage regulator 24 is provided, having a current bi-pass switch 25, wherein typically the voltage regulator 24 is configured to permit five voltage metering therethrough in mounting a battery 16 of a nine-volt capacity, wherein the voltage regulator 24 includes a current bi-pass switch 25 to permit voltage in excess of five volts directed through the voltage regulator 24, with a positive output cable 26 and a negative output cable 27 in electrical communication with the positive and negative terminals 16*a* and 16*b* respectively of the battery 16. As indicated in FIG. 2, the voltage regulator includes respective first and second posts 37 and 38 for mounting the respective positive and negative terminals 16*a* and 16*b* to the battery to the voltage regulator structure. A support spring clip 28 is mounted to the positive cable 26, with the mounting clip 29 mounted to the negative output cable 27. The mounting clip 29 includes a reciprocatable leg 30 reciprocatably mounted through a sleeve 31, wherein a plunger 32 captures a plunger spring 33 between the plunger and a sleeve head 34 to bias the reciprocatable leg 30 within the sleeve 31 to secure for example the support clip or further support clip structure 18 and 19 thereto, in a manner as indicated in FIG. 1 for example. A container 35 containing sodium cyanide and gold chloride in solution.

Within one quart of distilled water that is heated to one hundred fifty degrees F., 5.5 grams of sodium cyanide granules are mixed until the granules are totally dissolved, whereupon the distilled water is allowed to cool to ambient temperature. Once the solution is thusly cooled, one gram of gold chloride is added to the cyanide solution to perform a fluid solution 40 within the beaker 14, as indicated in FIG. 1. Current is then directed to the gold anode plate 17 through the nine volt battery 16, with a workpiece "W" mounted upon the further support clip 19, as indicated in FIG. 1. Plating to the workpiece "W" is thusly effected, whereupon the degree and depth of such plating is available to one and is adjustable and variable dependent upon the thickness of plating desired, where individual inspection indicates the initial plating to the workpiece "W" in use of the organization. Further, the positive current flow is directed to the positive output cable 26 to the gold anode plate 17.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A gold plating kit apparatus, comprising, a storage container, the storage container including a container lid and a container cavity directed within the storage container, wherein the container cavity includes a beaker, the beaker including a pour spout, and a battery member contained within the storage container, and a voltage regulator, the voltage regulator including a voltage regulator first post and a voltage regulator second post, the battery having a battery positive terminal and a battery negative terminal arranged for respective mounting the regulator first post and the regulator second post, and a positive output cable directed from the voltage regulator, and a negative output cable directed from the voltage regulator, and a first spring clip member mounted to the positive output cable, and a second spring clip member to the negative output cable, and a first generally S-shaped support clip for securement to the first spring clip, and a gold anode plate having an aperture therethrough arranged for mounting upon the support clip, and a further support clip arranged for receiving a workpiece thereon, and the first support clip arranged for securement to the second spring clip, and a first container adapted to have sodium cyanide granules therewithin, and a second container adapted to have gold chloride therewithin, and the second spring clip includes a sleeve, and a reciprocatable leg member mounted within the sleeve directed through the sleeve and projecting beyond a forward end of the sleeve, wherein the sleeve includes a sleeve head mounted to the sleeve, and a plunger mounted to the reciprocatable leg, the plunger including a plunger spring oriented between the plunger and the sleeve head, the plunger secured to the reciprocatable leg for biasing the reciprocatable leg within the sleeve for securement of the further support clip to the reciprocatable leg.

2. An apparatus as set forth in claim 1 wherein the voltage regulator includes a voltage bi-pass switch means for directing full voltage flow from the battery through the positive output cable and the negative output cable, and the voltage regulator preset to permit five volts to be directed therethrough prior to actuation of the bi-pass switch means.

* * * * *